US006186856B1

(12) United States Patent
Chen

(10) Patent No.: US 6,186,856 B1
(45) Date of Patent: Feb. 13, 2001

(54) TOY OF EQUILATERAL TRIANGULAR BUILDING BLOCKS

(76) Inventor: Ching Yean Chen, No. 68, Section 5, Yen Ping North Road, Taipei (TW)

( * ) Notice: Under 35 U.S.C. 154(b), the term of this patent shall be extended for 0 days.

(21) Appl. No.: 08/967,336

(22) Filed: Oct. 21, 1997

(51) Int. Cl.[7] ..... A63H 33/08
(52) U.S. Cl. ..... 446/128; 446/125; 446/117
(58) Field of Search ..... 446/117, 125, 446/128; D21/108

(56) References Cited

U.S. PATENT DOCUMENTS

| | | | | |
|---|---|---|---|---|
| D. 259,762 | * | 7/1981 | Sabin | D21/108 |
| D. 311,939 | * | 11/1990 | Andersen | D21/108 |
| D. 333,853 | * | 3/1993 | Knudsen | D21/108 |
| 4,731,041 | * | 3/1988 | Ziegler | 446/128 |
| 4,964,834 | * | 10/1990 | Myller | 446/128 |
| 5,553,967 | * | 9/1996 | Uozumi | 446/125 |

* cited by examiner

*Primary Examiner*—Robert A. Hafer
*Assistant Examiner*—Jeffrey D. Carlson

(57) ABSTRACT

The present invention concerns a building block toy, characterized in that a single kind of building block is used and in that the building block is of a unique shape. Specifically, the center of a flat equilateral triangular piece and the center of a flat hexagonal piece with the same thickness can be overlapped, and the three conjugated sides of the hexagonal piece can be connected to the three sides of the equilateral triangular piece upon stacking these two pieces in a parallel manner. The length of each side of the equilateral hexagonal piece is ⅓ of that of the side of the equilateral triangular piece. Thus, the parts where the equilateral triangular piece and the equilateral hexagonal piece overlap form three small equilateral triangular pieces (1, 2 and 3) of equal size. More importantly, one of the three small equilateral triangular pieces (1) is removed and transferred to the side of the hexagonal piece for connection in such a manner that the direct-view diagram of the front side or back side of the equilateral triangular block of the present invention shows an equilateral triangle. In addition, the front side of the equilateral triangular block of the present invention is equipped with projectiles (4, 5 and 6) (that is, on the three small equilateral triangles and the equilateral hexagon), and the back side is equipped with cups (7, 8 and 9) at positions opposite the projectiles, so that the equilateral triangular building blocks can be stacked together by means of the projectiles and cups.

1 Claim, 7 Drawing Sheets

TOY OF EQUILATERAL TRIANGULAR BUILDING BLOCKS

BACKGROUND OF THE INVENTION

The present invention offers a novel building block toy based on a new concept that is different from those of the many types of building block toys currently available in the marketplace. Conventional building block toys typically consist of many kinds of square and rectangular building-block pieces. However, the building block toy of the present invention involves the use of a single kind of building block and the employment of an equilateral triangular configuration and function. The present building block pieces can be joined together in vertical and horizontal configurations, and possess areas that allow the building block pieces to be joined together along oblique lines. Because of this unique feature of the present invention, many complex figures can be obtained with a single kind of building block.

The unique feature of the present invention offers new challenges to the user and acts as a tool for understanding geometric principles and applications. In addition, the use of a single kind of individual building block allows the user to focus on the geometric applications and variations during a game, which is particularly beneficial for young children in developing their reasoning skills and for adults in providing them with a novel practical game.

DESCRIPTION OF THE PREFERRED EMBODIMENT

Figure 1:
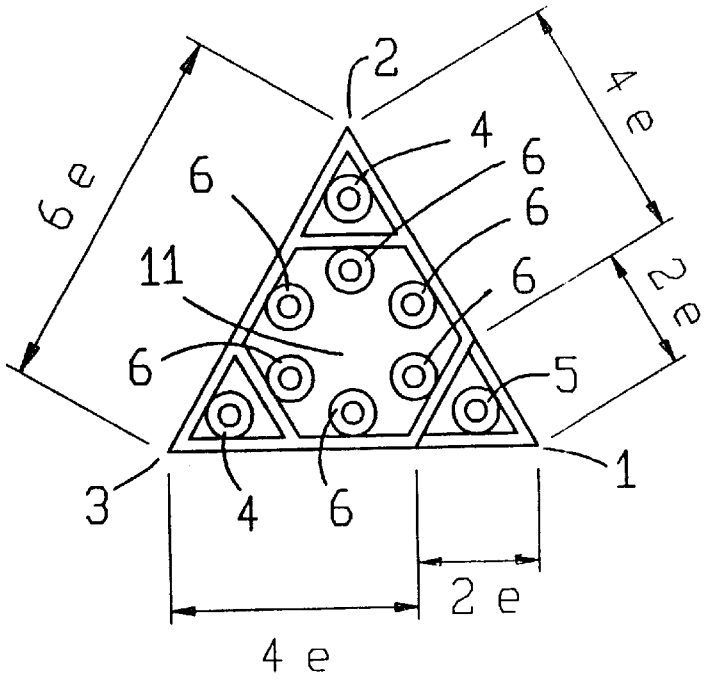
FIG. 1 is a front view of a equilateral triangular building block of the present invention.
Figure 2:
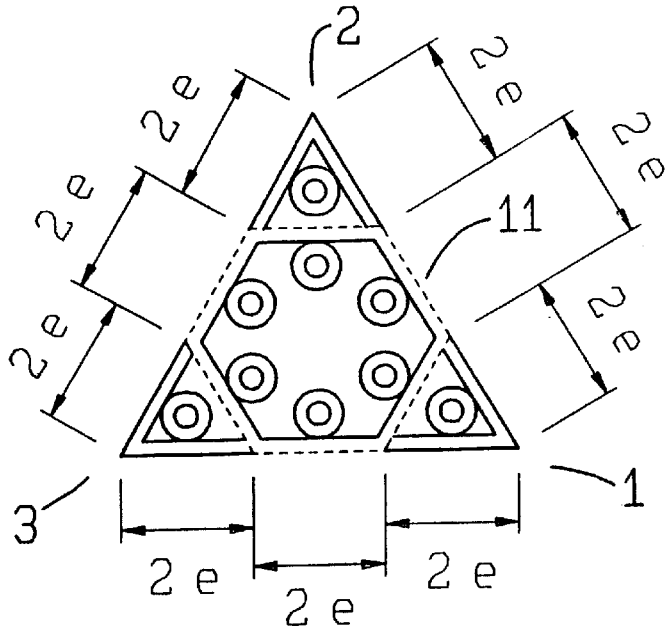
FIG. 2 is another front view of the present invention.
Figure 3:
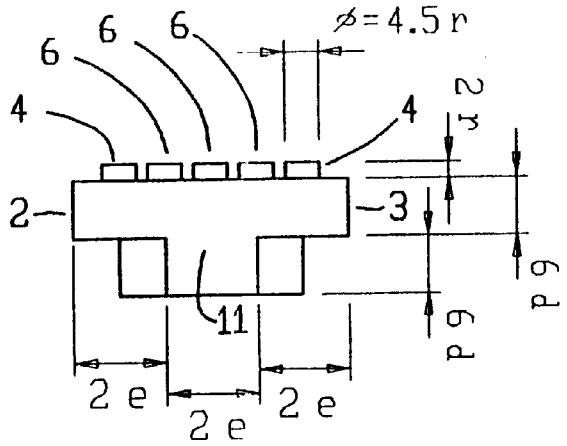
FIG. 3 is a side-view of the area between the apexes 2 and 3 of the present invention.
Figure 4:
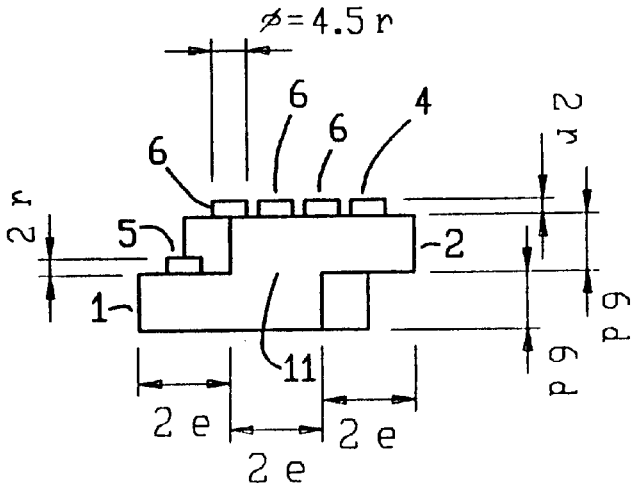
FIG. 4 is a side-view of the area between the apexes 1 and 2 of the present invention.
Figure 5:
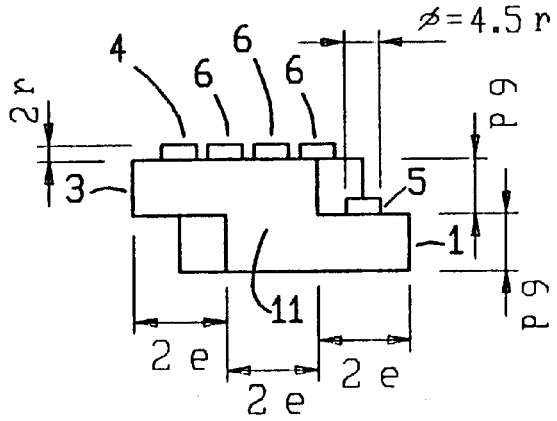
FIG. 5 is a side-view of the area between the apexes 3 and 1 of the present invention.
Figure 11:
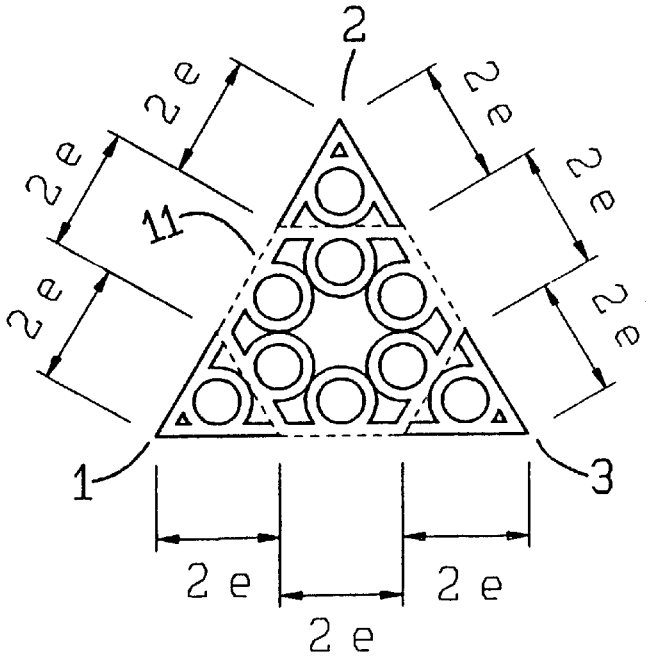
FIG. 11 is another rear-view of the present invention.

In FIG. 1, the front view diagram shows an equilateral triangular building block. Notations 4, 5 and 6 are cylindrical projectiles of an identical diameter. Notations 1, 2 and 3 relate to three apexes of the equilateral triangular building block of the present invention, which also represent the locations of 4, 5 and 6 (that is, three small equilateral triangles of equal size0. In FIGS. 2 and 11, Notation 11 denotes an equilateral hexagon (that is, the figure outlined with dotted lines).

In FIGS. 3, 4 and 5, 1, 2 and 3 have the same thickness, but the height of 1 is different from the height of 2 and 3 for the purpose of providing corresponding heights, so that 1's, 2's and 3's of various pieces of the equilateral triangular building blocks of the present invention can be interstacked during a stacking game.

Figure 6:
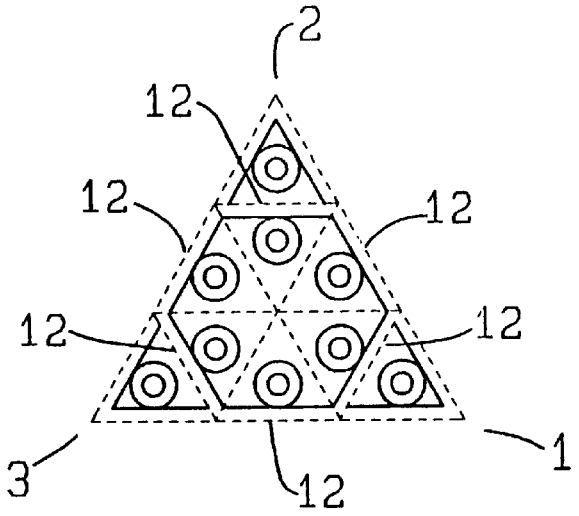
FIG. 6 is another front view of the present invention.
Figure 7:
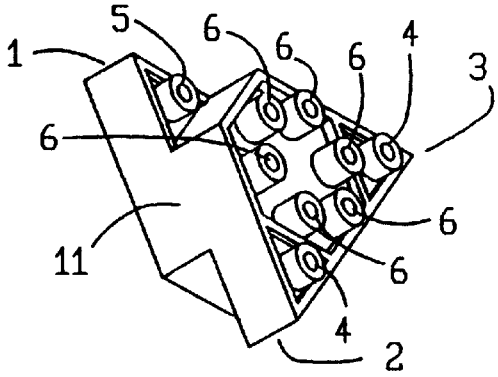
FIG. 7 is a perspective view of the area between the apexes 1 and 2 of the present invention.
Figure 8:
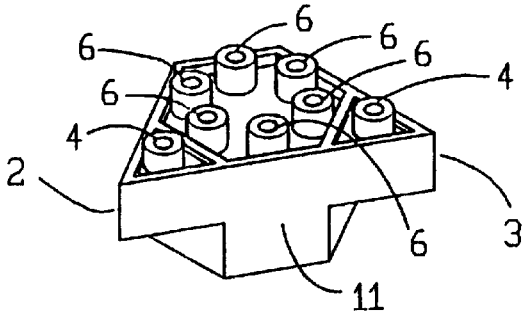
FIG. 8 is a perspective view of the area between the apexes 2 and 3 of the present invention.
Figure 9:
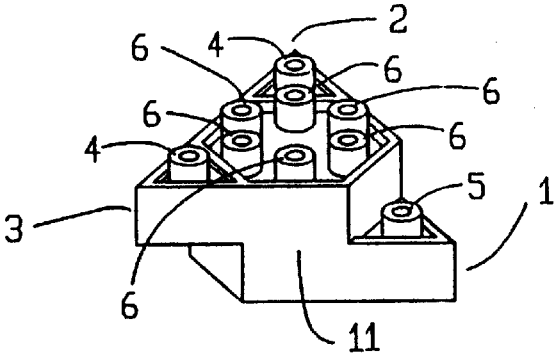
FIG. 9 is a perspective view of the area between the apexes 3 and 1 of the present invention.
Figure 12:
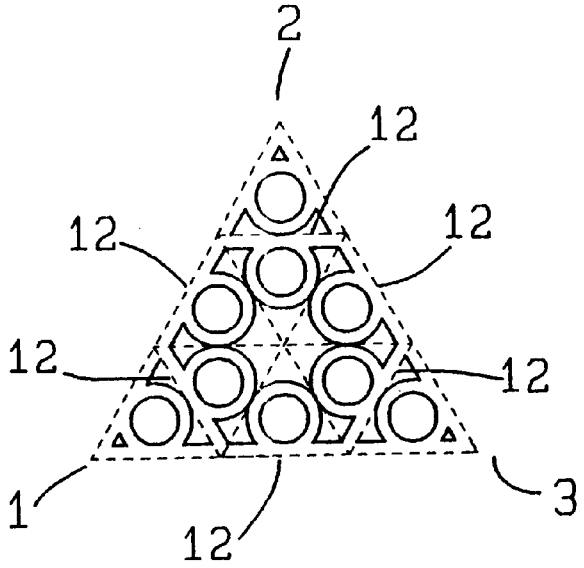
FIG. 12 is another rear-view of the present invention.
Figure 13:
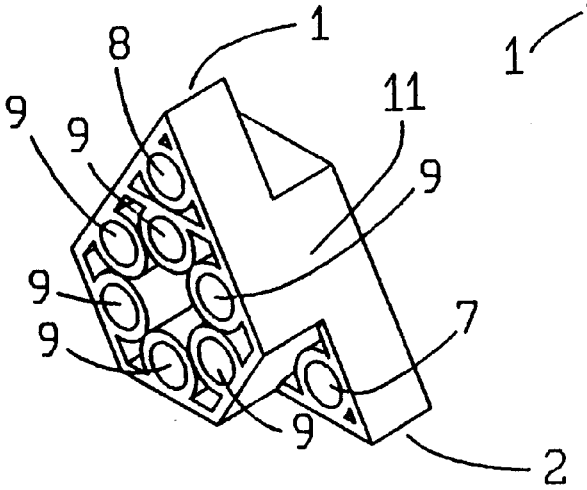
FIG. 13 is a perspective view of the area between the apexes 2 and 1 of the rear-view of the present invention.
Figure 14:
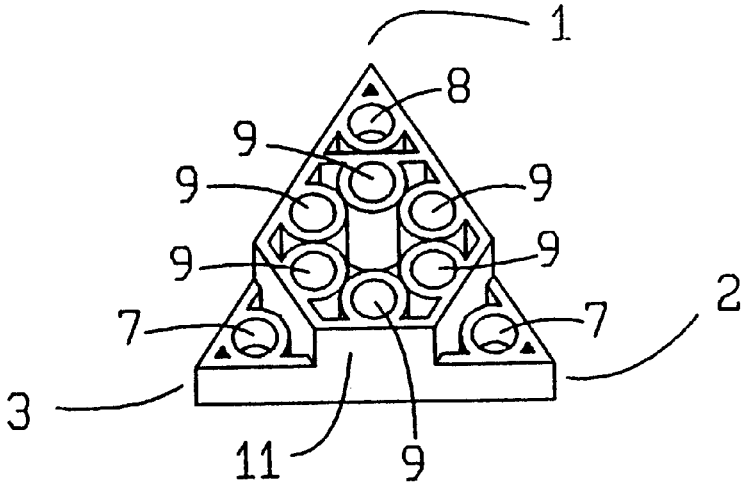
FIG. 14 is a perspective view of the area between the apexes 3 and 2 of the rear-view of the present invention.
Figure 15:
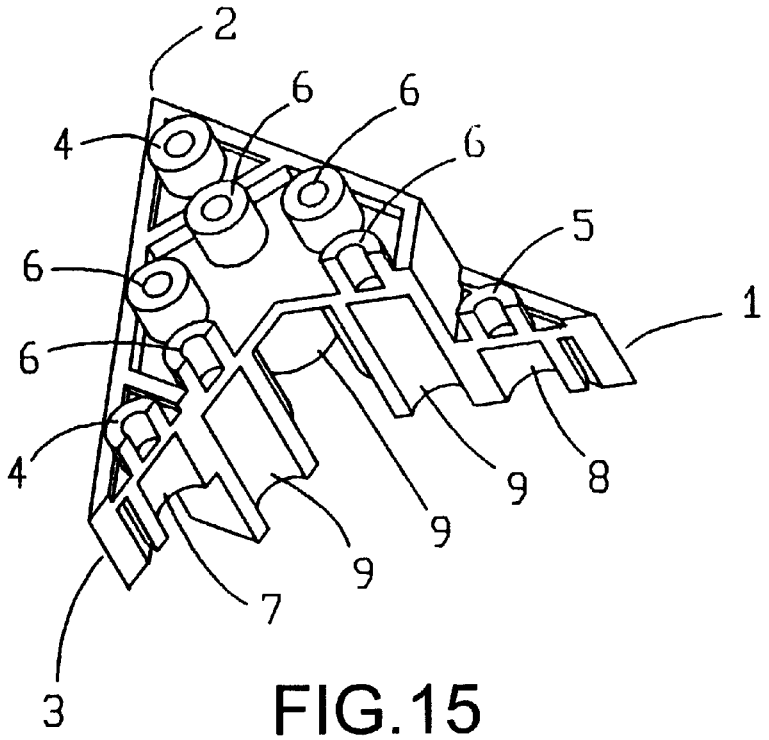
FIG. 15 is a perspective view of the area between the apexes 3 and 1 of the rear-view of the present invention.
Figure 16:
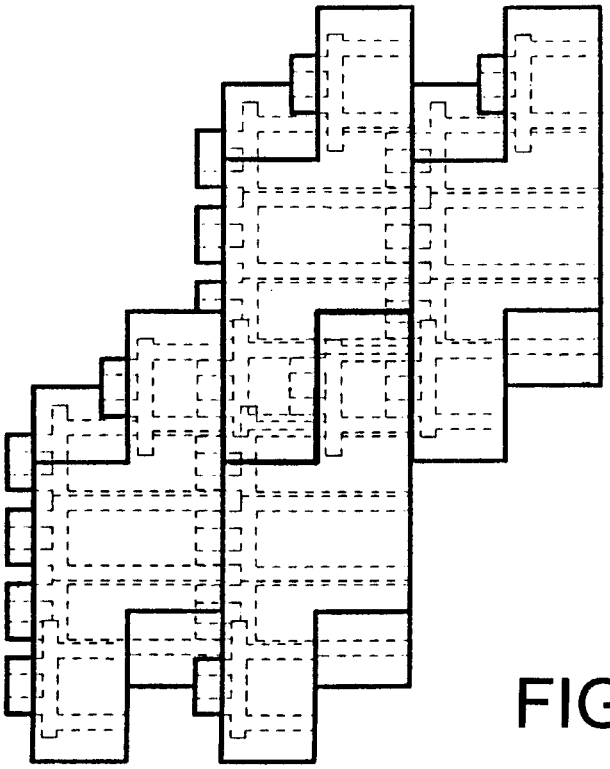
FIG. 16 is an indicative showing a see-through view of the interior of several interstacking equilateral triangular building blocks of the present invention.

In FIGS. 6 and 12, Notation 12 relates to six small equilateral triangles of the same size obtained by dividing the equilateral hexagon with dotted lines.

Figure 10:
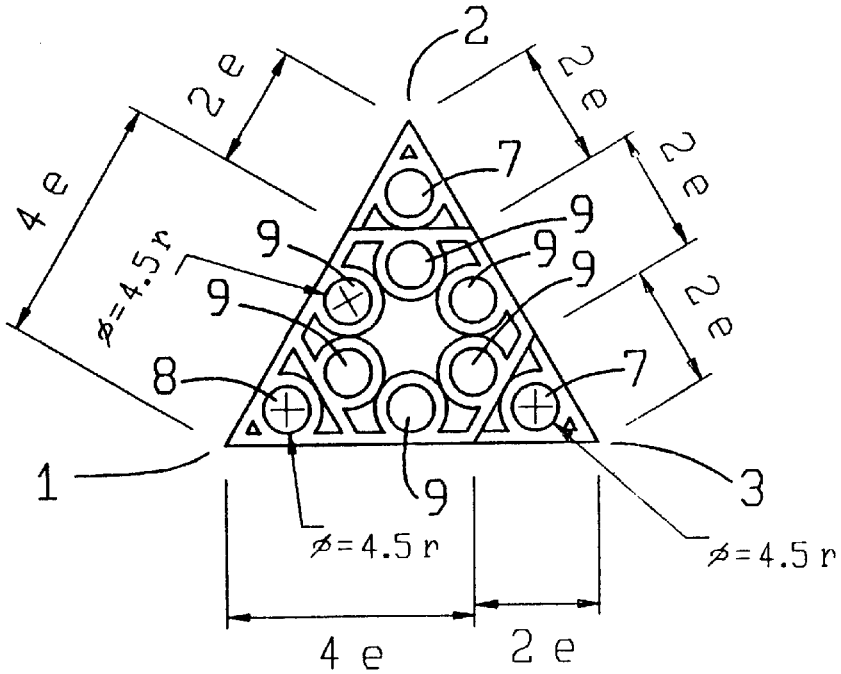
FIG. 10 is a rear-view of the present invention.

FIG. 10 shows the front view of the rear diagram, in which Notations 7, 8 and 9 are cylindrical cups of identical diameter. In addition, these cylindrical cups possess the same diameter as that of the cylindrical projectiles 4, 5 and 6 of the above-mentioned front-view diagram, allowing the cylindrical cups to snap onto the cylindrical projectiles.

FIGS. 1, 2, 3, 4, 5, 10 and 11 show notations for the length, thickness (height) and diameter, which are represented using different units (that is, d, e and r). The reason for using these different units is to indicate that there are no absolute relationships between the length, thickness and diameter. Rather, when the numerical value of one unit (dimension) is changed, the numerical values of the other two dimensions can also be changed in the same or different proportions. Cases in which the length, the height (thickness) or the diameter are identical are referred to as an absolute relationship. That is, when the numerical value of one of the parameter is changed, the numerical values of the other parameters having the same unit must also be changed in the same proportion.

In FIG. 6, the front-view diagram is divided into nine small equilateral triangles of equal size, using dotted lines, and the center of each of the small equilateral triangles is exactly the center of the circle (that is, the projectile in the front-view diagram) inside each of the small equilateral triangles encircled with dotted lines. In the same manner, the rear-view diagram in FIG. 12 is also divided into nine equal-size small equilateral triangles, using dotted lines, and the center of each of the small equilateral triangles is exactly the center of the circle (that is, the cup in the front-view diagram) inside each of the small equilateral triangles encircled with dotted lines. By comparison, the nine small equilateral triangles in FIG. 6 and the nine small equilateral triangles in FIG. 12 are on opposite sides of each other, the former being in the front and the latter being in the back. Moreover, the small front and back equilateral triangles are in the same direction and of the same size. Therefore, each of the small equilateral triangles in the two figures (that is, FIGS. 6 and 12) can be used as a stacking side for creating a stacked structure.

Figure 17:
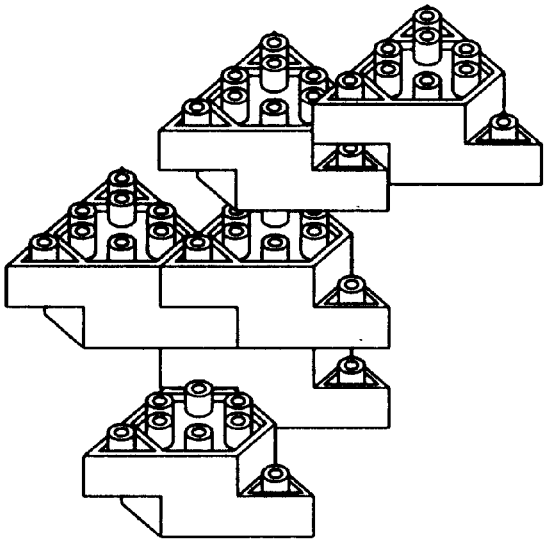
FIG. 17 is an indicative showing an example of a shape formed from the present invention.
Figure 18:
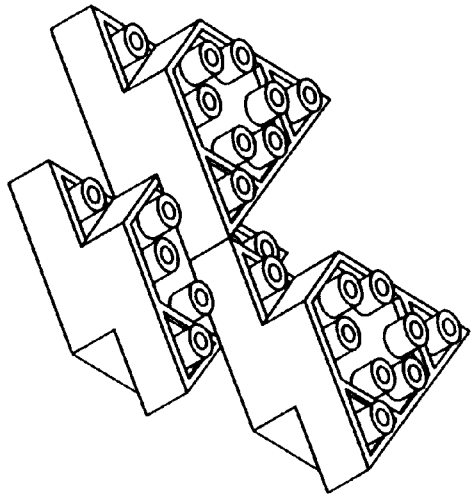
FIG. 18 is an indicative showing another example of a shape formed from the present invention.
Figure 19:
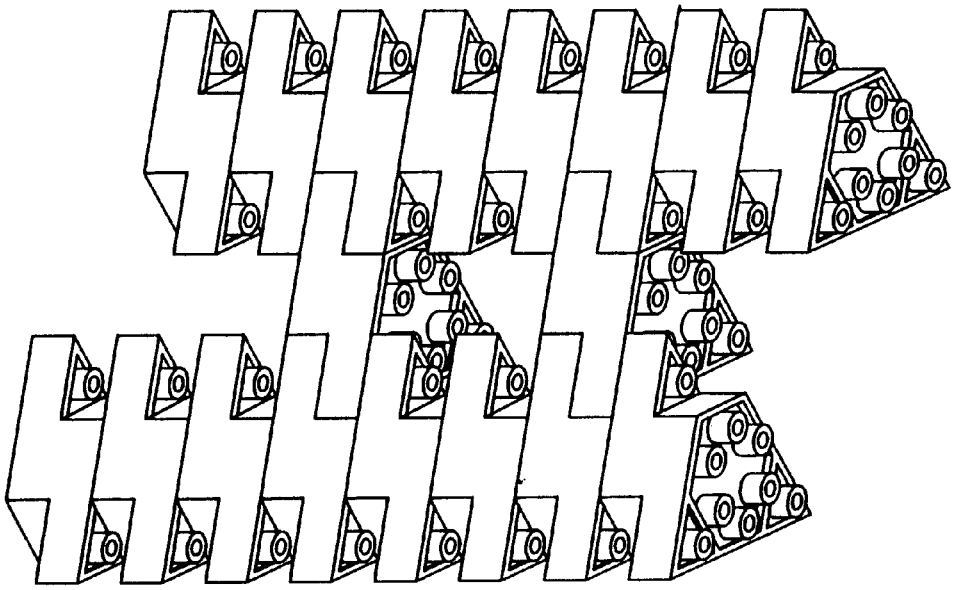
FIG. 19 is an indicative showing another example of a shape formed from the present invention.

FIGS. 17, 18 and 19 show examples of a shape formed from equilateral triangular building blocks of the present invention. In particular, the shape shown in FIG. 19 is constructed using an upright stacking technique that involves extending the figure upward at an inclined angle to form a structure with a large sloped surface. In this manner, the equilateral triangular building block of the present invention is unique in comparison with typical square or rectangular building blocks, and is like a molecule, a cell or a grain of sand that can multiply infinitely.

I claim:

1. A flat building block toy, wherein (a) both the front and rear have an equilateral triangular shape, (b) the central part of the equilateral triangular is divided at intervals of ⅓ of the length of each of the sides of the equilateral triangle to form an equilateral hexagonal zone (11) and three small equilateral triangular zones (1, 2 and 3) at the three corners of the equilateral triangle, with the length of each hexagonal side being ⅓ of that of the equilateral triangle, (c) the thickness of the three small equilateral triangular zones (1, 2 and 3) is ½ of the thickness of the central hexagonal zone (11), (d) one small equilateral triangular zone (1) among the three small equilateral triangular zones (2 and 3), (e) the equilateral triangular building block is divided into nine equal side small equilaterial triangles, which include three small equilateral triangular zones (1, 2 and 3) at the three corners of the equilateral triangular building block and six equal-size small equilateral triangular zones (12) obtained by dividing the central equilateral hexagonal zone (11), and (f) each front side of these nine small equilateral triangular zones possesses a projection of the same size (4, 5 and 6) the back side of these nine small equilateral triangular zones possesses a cup of the same size complimentary to the projection, so that these nine projections and the nine cups can be stacked together during a stacking game.

* * * * *